US006718555B2

(12) United States Patent
Hofmann

(10) Patent No.: US 6,718,555 B2
(45) Date of Patent: Apr. 13, 2004

(54) PILOT'S GLOVE

(75) Inventor: Marianne Hofmann, Düsseldorf (DE)

(73) Assignee: Blücher GmbH, Erkrath (DE)

( * ) Notice: Subject to any disclaimer, the term of this patent is extended or adjusted under 35 U.S.C. 154(b) by 0 days.

(21) Appl. No.: 10/275,378

(22) PCT Filed: Mar. 15, 2001

(86) PCT No.: PCT/EP01/02883

§ 371 (c)(1),
(2), (4) Date: Nov. 4, 2002

(87) PCT Pub. No.: WO01/82728

PCT Pub. Date: Nov. 8, 2001

(65) Prior Publication Data

US 2003/0074714 A1 Apr. 24, 2003

(30) Foreign Application Priority Data

May 4, 2001 (DE) ..... 200 08 047 U

(51) Int. Cl.[7] ..... A41D 19/00
(52) U.S. Cl. ..... 2/159; 2/169
(58) Field of Search ..... 2/16, 21, 159, 2/161.1, 161.3, 161.5, 161.6, 161.7, 161.8, 163, 167, 169

(56) References Cited

U.S. PATENT DOCUMENTS 1,377,338 A * 5/1921 Grinnell ..... 2/169
2,386,688 A * 10/1945 Julianelli et al. ..... 2/169
3,961,377 A * 6/1976 Lars-Jos ..... 2/169
4,218,779 A * 8/1980 Hart et al. ..... 2/168
4,507,807 A * 4/1985 Karkanen ..... 2/161.8
5,231,700 A * 8/1993 Cutshall ..... 2/161.7
5,614,301 A * 3/1997 Katz ..... 442/315
6,006,359 A * 12/1999 Lazarus ..... 2/169
6,029,276 A * 2/2000 White ..... 2/161.6
6,395,383 B1 * 5/2002 Maples ..... 428/319.3

FOREIGN PATENT DOCUMENTS

JP 9-279408 * 9/1997 ..... A41D/19/00
JP 2001-262413 * 9/2001 ..... A41D/19/00
SE WO 98/01044 * 1/1998 ..... A41D/19/02

* cited by examiner

*Primary Examiner*—Gary L. Welch
(74) *Attorney, Agent, or Firm*—Cohen, Pontani, Lieberman & Pavane

(57) ABSTRACT

A pilot's glove includes a first material piece for covering a hand front side and a second material piece for covering a hand rear side. The first and second material pieces have edges by which the first and second material pieces are connected to one another to forma seam which lies on a rear side of the hand when the glove is worn, so that the fingertips are free of seams and all seams lie on the hand rear side. The front side and rear side each have a hydrophobic and oleophobic finish for protection against chemical warfare agents.

24 Claims, 3 Drawing Sheets

PILOT'S GLOVE

PRIORITY CLAIM

This is a U.S. national stage of application No. PCT/EP01/02883, filed on Mar. 15, 2001. Priority is claimed on that application and on the following applications:

Country: Germany, Application No.: 200 08 047.4, Filed: May 4, 2000;

Country: USA, application Ser. No. 09/629,593, Filed: Jul. 31, 2000.

The present invention relates to a glove with increased tactility. The present invention relates, in particular, to a glove which has no seams in the region of the fingertip and which is manufactured preferably from a material allowing excellent tactility.

The importance of protecting military pilots against chemical warfare agents cannot be underestimated. It is not difficult to contaminate an entire airfield. Even if the interior of an aircraft can be kept relatively "clean", the pilot may come into contact with chemical warfare agents on the way to his seat. Epispastic skin poisons, such as, for example, mustard gas (Yperite, yellow cross gas), are especially unpleasant. If the hands have been contaminated, the pilot cannot pilot an aircraft for weeks, because his hands lack all sensitivity. This risk cannot be underestimated, and therefore a great amount of care must be devoted to protecting the hands.

Gloves with a seam which runs along the side of the fingers and over the fingertips are known. However, because of their cut, such gloves impede tactility, in particular in the region of the fingertips. This is undesirable, particularly with regard to use by pilots, because increased tactility is required here, in order to operate the instruments inside the aircraft.

Gloves which are impermeable to specific chemicals are likewise known, but such chemically impermeable gloves are fashioned in such a way that they are also impermeable to water vapor, thus leading to increased perspiration of the hand inside the glove and therefore to tactility being impaired. Moreover, the chemically impermeable gloves known from the prior art are usually too thick to ensure sufficient tactility.

A glove is therefore required, which ensures some protection against hazardous chemical reagents, in particular warfare agents, while at the same time maintaining a high degree of tactility.

SUMMARY AND DESCRIPTION OF THE INVENTION

The problem on which the present invention is based is to provide a glove with increased tactility, in particular for use by pilots and military pilots.

The object of the present invention is, in particular, to develop a glove, in particular for pilots, such as military pilots, which in no way impairs the ability to operate the most diverse possible instruments and knobs. Furthermore, such a glove should also be permeable to water vapor. In particular, such a glove should also protect against chemical warfare agents.

The problem on which the present invention is based is solved in that there are no seams present in the region of the fingertips.

The aim according to the invention is therefore achieved, on the one hand, in particular, by the selection of particularly soft materials and, on the other hand, by means of a special cut. The latter has been developed in such a way that no seams disturb "fingertip sensitivity". This is achieved in that the material of the underside is drawn upward over and beyond the fingertip to where seams no longer cause disturbance.

A soft glove which is designed in such a way that it makes it possible to actuate small switches, knobs, instruments, etc., which require "fingertip sensitivity", is, however, also pre-eminently suitable for a whole series of civil applications.

So that the glove protects against warfare agents, in particular skin poisons, an adsorption layer must be present, as in C-protection suits.

To avoid local perforations caused by a liquid warfare agent, a good hydrophobic and oleophobic finish is also recommended.

On the other hand, the pilot must be able to operate his instruments, unimpeded, which means that high tactility must be maintained. As described above, this is achieved in that there are no seams present in the region of the fingertips.

In other words, the present invention relates to a glove with increased tactility, which comprises a first material piece for covering a hand front side (inside) and a second material piece for covering a hand rear side (hand back). The first material piece has, in particular, the shape of a hand with fingers, extends, in each case over more than half, around the circumference of each finger and is narrowed toward the fingertips, the narrowed end in each case extending beyond the fingertip of each finger. In other words, each free end of a finger-forming portion of the first material piece extends on to the rear side around an associated fingertip and is narrowed toward the free end. The second material piece likewise has, in particular, the shape of a hand with fingers and extends, less than half, around the circumference of each finger and below the fingertip of each finger. At the same time, the first and second material pieces are connected or stitched to one another along the edge, so that, when the glove is worn, all the seams lie on the hand rear side, that is to say there are no seams present in the region of the fingertips.

FIGS. 1 and 2 clearly show this special and novel type of manufacture of the fingertips of the glove.

FIG. 1 shows the inside (A) and rear side (B) of the finished glove, while

Figure 1:
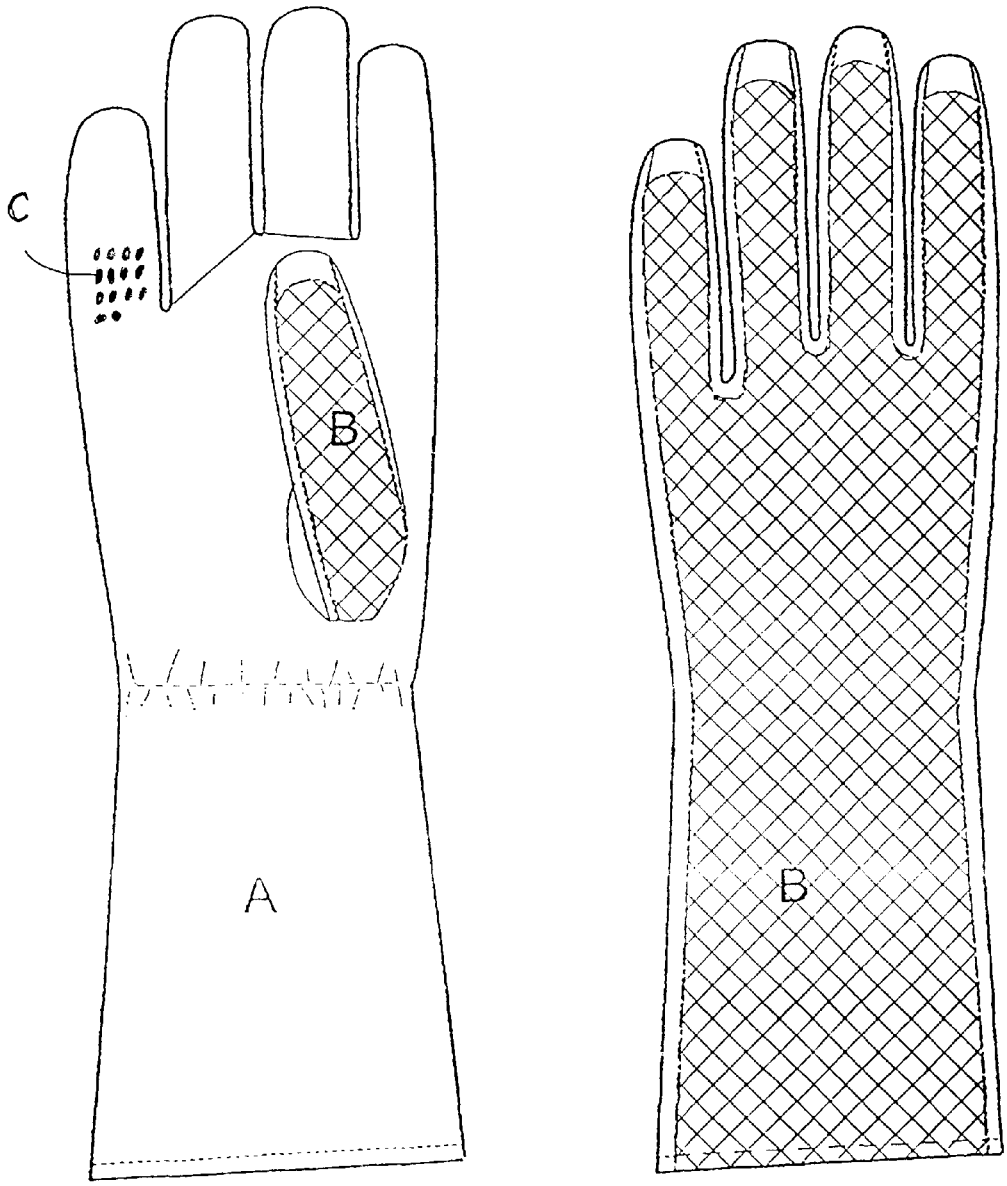
Figure 2:
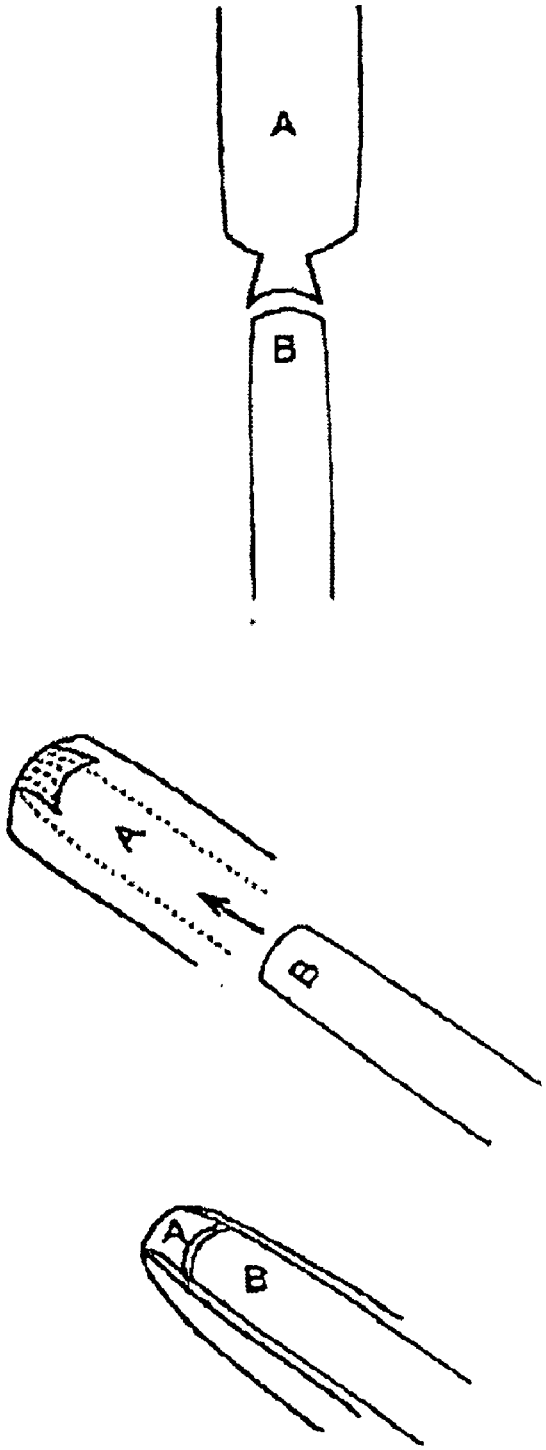
FIG. 2 illustrates how seams are avoided under the fingertips by means of the special cut.
Figure 3:
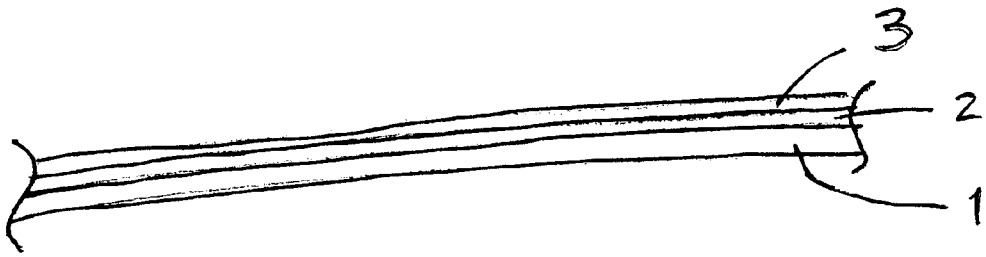
FIG. 3 is a sectional view of the layers of materials used to make the front and rear sides A, B of the glove.

The adsorption material, present if appropriate, is produced, in particular, by a method which has proved appropriate worldwide for chemical protection suits. In this case, a spheroidal highly abrasion-resistant activated charcoal, in particular, with a means diameter of around 0.5 mm, is bonded to a carrier material, for example with the aid of an adhesive printed on in spots, and, if appropriate, is provided with a light covering. The granular adsorbent particles may be provided in a quantity of 100 to 200 g/m$^2$. FIG. 3 shows an example of the layers of materials used to make the front and rear sides A, B of the glove. The carrier material 1 itself is a longitudinally elastic warp fabric composed of skin-compatible fibers (for example, cotton) with a weight of usually (100±30) g/m$^2$, while the covering 2 may, for example, be a light knitted cloth. The exterior material 3 may be a very soft leather or a sufficiently stretchable textile material, the thickness, structure, and fibrous material of which may vary within wide limits, so that the person skilled in the art has many possibilities available to him.

The grip afforded by the glove according to the invention may be increased by means of spots, bumps, or bosses C of a moderately soft plastic which are printed on the inside of the glove, that is to say on the side opposite the back of the hand. An example which may be mentioned in Impranil HS 62 which has been crosslinked with Impranil HSC and has been printed by means of a 14-mesh screen (coating 50 to 100 g/m$^2$).

In a preferred version, soft goatskin is used for the inside, that is to say for the side opposite the back of the hand. A good hydrophobic and oleophobic finish already affords good protection without an adsorption layer. For the side covering the back of the hand, an air-permeable textile material may be used, which may be lined with the adsorption layer already described.

In another version, the leather, too, may be lined with an adsorption layer.

In yet another version, instead of leather, a high-wearing longitudinally elastic material may be used, which may have a hydrophobic and oleophobic finish.

Finally, in a version for civil applications, there may be no adsorption layer at all.

However, all the versions have in common the fact that the fingertips are free of disturbing seams.

What is claimed is:

1. A glove with increased tactility and water-vapor permeability properties, comprising:

a first material piece for covering a hand front side, the first material piece being shaped as a hand with fingers, extending, in each case over more than half, around a circumference of each finger and narrowing toward the fingertip to form a narrowed end that extends in each case beyond the fingertip of each finger; and a second material piece for covering a hand rear side, the second material piece being shaped as a hand with fingers and extending, less than half, around the circumference of each finger and only to below the fingertip of each finger;

the first and second material pieces having edges by which the first and second pieces are connected to one another so as to form a seam which lies on a rear side of the hand when the glove is worn, so that the fingertips are free of seams and all seams lie on the hand rear side, wherein the material of the front side and the rear side of the glove has a hydrophobic and oleophobic finish for protection against chemical warfare agents.

2. A glove as defined in claim 1, wherein at least one of said first and second material pieces comprises an adsorption layer.

3. A glove as defined in claim 2, wherein the adsorption layer is a layer for adsorption of chemical warfare agents.

4. A glove as defined in claim 2, wherein the adsorption layer comprises: a carrier material and granular adsorbent particles bonded by means of an adhesive printed onto the carrier material.

5. A glove as defined in claim 4, wherein the carrier material is an air-permeable longitudinally elastic warp fabric composed of skin-compatible fibers.

6. A glove as defined in claim 4, wherein the carrier material has a weight of 100±30 g/m$^2$.

7. A glove as defined in claim 4, wherein the granular adsorbent particles are spheroidal.

8. A glove as defined in claim 7, wherein the granular particles are highly abrasion-resistant activated charcoal.

9. A glove as defined in claim 7, wherein the spheroidal adsorbent particles have a mean diameter of about 0.5 mm.

10. A glove as defined in claim 4, wherein the granular adsorbent particles are provided in a quantity of 100 to 200 g/m$^2$.

11. A glove as defined in claim 4, wherein the adsorbent particles are bonded onto the carrier material by an adhesive printed on in spots.

12. A glove as defined in claim and further comprising a light covering applied to the adsorbent particles.

13. A glove defined in claim 12, wherein the light covering is a light knitted cloth.

14. A glove as defined in claim 1, wherein the front side of the glove is made from soft leather.

15. A glove as defined in claim 14, wherein the leather is lined with an adsorption layer.

16. A glove as defined in claim 15, wherein the adsorption layer consists of a skin-compatible air-permeable longitudinally elastic textile material, on which granular adsorbents are fixed in a quantity of 100 to 200 g/m$^2$ by means of a printed-on adhesive compound and are themselves covered by a light elastic cloth.

17. A glove as defined in claim 1, wherein the rear side of the glove is made of an air-permeable longitudinally elastic and skin-compatible material.

18. A glove as defined in claim 17, wherein the air-permeable longitudinally elastic and skin-compatible material is lined with an adsorption layer.

19. A glove as defined in claim 18, wherein the adsorption layer consists of a skin-compatible air-permeable longitudinally elastic textile material, on which granular adsorbents are fixed in a quantity of 100 to 200 g/m$^2$ by means of a printed-on adhesive compound and are themselves covered by a light elastic cloth.

20. A glove as defined in claim 1, wherein both sides of the glove are made of leather.

21. A glove as defined in claim 20, wherein the leather is lined with an adsorption layer.

22. A glove as defined in claim 1, wherein both sides of the glove are made of a longitudinally elastic air-permeable and skin-compatible material.

23. A glove as defined in claim 22, wherein the air-permeable longitudinally elastic and skin-compatible material is lined with an adsorption layer.

24. A glove as defined in claim 1, and further comprising bosses of a medium-soft plastic which are printed on the front side of the glove so as to increase the grip of the glove hand.

* * * * *